US011780615B2

(12) United States Patent
Arbulu Ormaechea et al.

(10) Patent No.: US 11,780,615 B2
(45) Date of Patent: Oct. 10, 2023

(54) THERMOSEALING MACHINE FOR PACKAGING PRODUCTS

(71) Applicant: ULMA Packaging, S. Coop., Oñati (ES)

(72) Inventors: Nerea Arbulu Ormaechea, Oñati (ES); Julen Etxaniz Ortiz, Oñati (ES)

(73) Assignee: ULMA PACKAGING, S. COOP., Oñati (ES)

( * ) Notice: Subject to any disclaimer, the term of this patent is extended or adjusted under 35 U.S.C. 154(b) by 149 days.

(21) Appl. No.: 17/394,087

(22) Filed: Aug. 4, 2021

(65) Prior Publication Data

US 2022/0111981 A1 Apr. 14, 2022

(30) Foreign Application Priority Data

Oct. 9, 2020 (EP) ..... 20382895

(51) Int. Cl.
*B65B 7/28* (2006.01)
*B65B 31/02* (2006.01)
*B65B 43/46* (2006.01)

(52) U.S. Cl.
CPC ..... *B65B 7/2878* (2013.01); *B65B 31/028* (2013.01); *B65B 43/46* (2013.01)

(58) Field of Classification Search
None
See application file for complete search history.

(56) References Cited

U.S. PATENT DOCUMENTS 7,269,932 B2 * 9/2007 Konishi ..... B65B 7/164 53/329.4
2005/0257501 A1 * 11/2005 Natterer ..... B65B 7/164 53/329.3

FOREIGN PATENT DOCUMENTS

| | | | |
|---|---|---|---|
| DE | 10031356 | A1 | 1/2002 |
| EP | 3235741 | A1 | 10/2017 |
| WO | 2011012652 | A1 | 2/2011 |
| WO | 2018018016 | A1 | 1/2018 |

* cited by examiner

*Primary Examiner* — Tanzim Imam
(74) *Attorney, Agent, or Firm* — Edell, Shapiro & Finnan, LLC

(57) ABSTRACT

According to one embodiment a thermosealing machine is provided that includes a movable lower mold with a box formed by a box base, a box structure, and a box frame attached to the box structure. The box frame includes a frame cavity, and the lower mold includes a pad coupled to the box frame with freedom of vertical movement. The thermosealing machine includes a lower stop and an upper stop, the upper stop being operatively coupled to the pad and vertically movable with the pad. The upper stop is configured to move between an inoperative position and an operative position. In the operative position the upper stop is arranged in the path of travel of the lower stop. In the inoperative position the upper stop is arranged outside of the path of travel of the lower stop.

19 Claims, 3 Drawing Sheets

THERMOSEALING MACHINE FOR PACKAGING PRODUCTS

CROSS-REFERENCE TO RELATED APPLICATIONS

This application relates to and claims the benefit and priority to European Application No. EP20382895.9, filed Sep. 10, 2020.

TECHNICAL FIELD

The present invention relates to thermosealing machines for packaging products, particularly to thermosealing machines generating a vacuum for packaging products.

BACKGROUND

There are different types of machines for packaging products, depending on needs. In some cases, the products are arranged on preformed trays and covered with a cover sheet that is sealed to the trays. The machines configured for making packages of this type are known as thermosealing machines.

Thermosealing machines comprise a vacuum generation system associated with a sealing station with an upper mold and a lower mold. The lower mold is typically movable towards the upper mold such that the molds can be arranged in an open position in which both molds are distanced from one another and a closed position in which both molds cooperate with one another. The upper mold further comprises heating means suitable for sealing a cover sheet to the tray, with said cooperation in the closed position. The trays, which generally comprise a cavity for housing the product and a flap surrounding the cavity, are supported on the lower mold and a cover sheet is arranged thereon, such that the cover sheet is trapped between both molds in the closed position, causing said cover sheet to be sealed to the tray by heat and pressure.

Some thermosealing machines generate a vacuum for packaging the products. Machines of this type allow vacuum packages, second skin packages, and/or modified atmosphere packages to be generated. In these cases, a vacuum is applied on the space defined between the cover sheet and the tray, which is the space where the product is housed. The vacuum requires a pressure below atmospheric pressure.

In those thermosealing machines generating vacuum packages, the vacuum is applied both from above the cover sheet and from below the tray, and both vacuums, in the event of two being generated, are ideally generated and act simultaneously to keep the cover sheet, and especially the tray, in the required position. However, in the event of a vacuum being generated on both sides of the cover sheet, due to the difference in volumes above the cover sheet and below the cover sheet, it is common for there to be a decompensation of pressures during said vacuum generation, even more so if the vacuum is only generated below the cover sheet. As a consequence, there is a risk that the tray becomes deformed downwardly, such that its integrity is compromised or deficient sealing is generated between the tray and the cover sheet.

In thermosealing machines generating second skin packages, first a vacuum is applied on the cover sheet, suctioning it towards the upper mold such that said cover sheet contacts a hot surface of the upper mold, then a vacuum is generated between said cover sheet and the tray, and finally air is introduced above the cover sheet for causing the movement of the cover sheet towards the tray. This is why during second skin vacuum packaging, the negative pressure generated when a vacuum is applied below the cover sheet, and the excess pressure generated when air is introduced above the cover sheet, may cause the tray to become deformed downwardly, such that its integrity is compromised or a deficient sealing is generated between the tray and the cover sheet.

Furthermore, in some thermosealing machines generating modified atmosphere packages, a vacuum reducing the amount of air and facilitating the introduction of a mixture of gases into the tray can also be generated below the cover sheet, such that during the generation of a vacuum, the tray may become deformed, comprising its integrity or the subsequent sealing of the cover sheet.

U.S. Publication No. 2005/0257501A1 discloses a thermosealing machine generating a vacuum for packaging products in trays. The thermosealing machine comprises an upper mold, a lower mold movable towards the upper mold, and a vacuum generating device for applying the vacuum. The lower mold comprises a frame and the machine comprises an actuator which, when actuated, pushes said frame, causing the movement of said lower mold towards the upper mold. The actuator comprises a base or pad acting against said frame, and a chamber is defined between said frame and said base, where the tray is arranged. The frame is configured such that there is a given space between the tray and the base which, while allowing downwards movement of the tray, also limits said movement, such that despite said movement taking place, deformation of the tray above acceptable parameters compromising the integrity thereof or a deficient sealing with the cover sheet is prevented.

International Publication No. WO2018/018016A1 discloses a thermosealing machine for packaging products in which a vacuum suitable for packaging products in trays is generated. The machine comprises a sealing station with an upper mold and a lower mold configured for being arranged in an open position in which they are distanced from one another and in a closed position in which they cooperate with one another, with the lower mold being configured for moving along a given path of travel in a vertical direction between the open position and the closed position of said molds. The lower mold comprises a frame with a frame cavity suitable for at least partially housing the tray, and a pad for supporting the tray from underneath during vacuum packaging.

SUMMARY

Disclosed is a thermosealing machine for packaging products. According to one embodiment, the thermosealing machine comprises a lower mold configured for moving along a vertical path of a given length between a first position and a second position. The lower mold comprises a box formed at least by a box base, a box structure extending vertically upwards from the box base, and a box frame comprising a frame cavity and attached to the box structure, such that a box cavity between is defined said box frame, said box structure, and said box base; and at least one pad attached to the box with freedom of vertical movement and associated with the frame cavity.

The machine comprises a lower stop which is associated with the lower mold such that it moves integrally with said lower mold during the movement of said lower mold from the first position to the second position, and at least one upper stop configured for moving between an operative position and an inoperative position. In the operative position, the upper stop is configured for being arranged in the path of travel of the lower stop during the movement of said lower stop integral with the lower mold, such that said upper stop moves integrally with said lower stop from the time said lower stop contacts said upper stop until the lower mold reaches the second position. In the inoperative position, the upper stop is arranged outside of said path of travel, such that the lower stop does not contact it along the path of travel of said lower stop integral with the lower mold.

During the movement of the lower mold from the first position to the second position, the lower stop contacts the upper stop arranged in the operative position, a situation which occurs before said lower mold completes said path of travel, causing the upper stop to be moved after that point integrally with said lower stop, and since the pad moves integrally with the upper stop, said pad also moves integrally with the lower mold after that time and until said lower mold reaches the second position.

The position of the upper stop in the path of travel of the lower stop when it is in the operative position is selected based on the height of the tray to be used during packaging, such that with the lower mold in the second position, a flap of said tray is supported on an upper surface of the box frame when said tray is arranged in a frame cavity and a base of said tray is supported on the pad or separated from the pad a maximum tolerance distance allowed, which may be up to 5 mm for example. A tray can be flat, in which case it comprises a base surrounded by a flap, or can demarcate a volume, in which case it comprises a body which demarcates the volume and is surrounded by a flap, the body comprising a base attached to the flap by means of a wall. The closer the upper stop is arranged to the lower stop with the lower mold in the first position, when said upper stop is in the operative position, the smaller said given height of the tray will be since the pad moves for a longer path of travel interval integral with said lower mold, being arranged closer to said upper surface of the box frame (or substantially at the same height, for the case of flat trays).

It is therefore possible to adapt the height of the pad with respect to the upper surface of the box frame on which the flap of a tray is supported when the lower mold finishes its given path of travel (when the lower mold is in the second position), based on the position of the upper stop, allowing the machine to be used for packaging products in trays of different heights. The presence of the pad and its adaptability based on tray height allows a vacuum to be generated if required, since the pad prevents unwanted deformation of the tray in these situations, and this is achieved without the need to replace any element. When a vacuum is generated in a packaging process (it would be generated with the lower mold in the second position), as described above, there is a risk of a decompensation of pressures during said vacuum generation being able to deform the tray in an undesired and unacceptable manner, and it is common to arrange the pad in contact with the base of the tray or at a minimum distance (around 5 mm at most) below the tray to prevent deformations of said tray from compromising the integrity of the tray or the sealing of the cover sheet to the tray. Therefore, the required pad position is different based on the height of the tray, since the flap of the tray is supported on the same surface of the box frame regardless of the height of the tray, and in the proposed machine different positions for the pad are made possible as a result of the mobility of the upper stop between an operative position and an inoperative position. The machine is therefore more flexible, and this is obtained in a quick and simple manner since it only requires changing the position of the upper stop without needing to disassemble or replace any of the molds or any of their elements, for example.

These and other advantages and features will become apparent in view of the figures and the detailed description.

DETAILED DESCRIPTION

Figure 1:
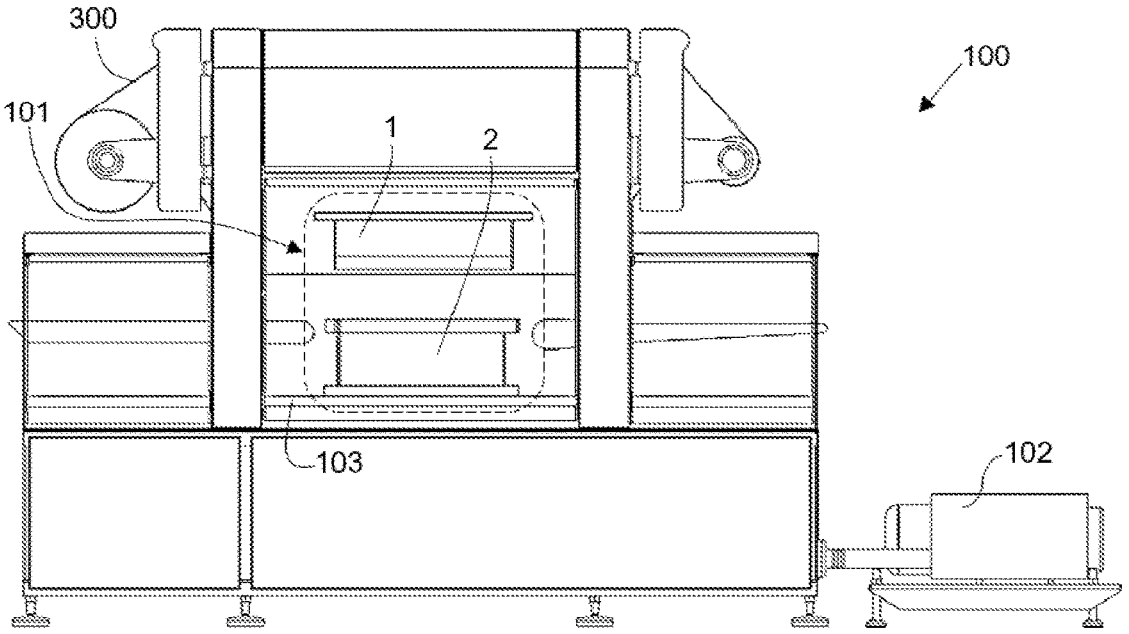
FIG. 1 schematically shows a thermosealing machine for packaging products according to embodiment.

FIG. 1 shows an embodiment of the thermosealing machine 100 for packaging products, which is suitable for generating a vacuum during packaging. The products are arranged in trays comprising a base on which the product is arranged (in flat trays), or a body in which the product is housed, and a flap around the base or of the body, as the case may be.

The machine 100 comprises an upper mold 1 and a lower mold 2 cooperating with one another for packaging the products, and a vacuum generation device 102 configured for generating the required vacuum during said packaging. The molds 1 and 2 are in a station 101 of the machine 100, typically known as a sealing station because a cover sheet is sealed therein to the tray (or trays) for packaging the products, when the molds 1 and 2 cooperate with one another. The vacuum generation device 102 can be part of the station 101 or be associated with it, for example. The lower mold 2 is configured for moving along a vertical path of travel of a given length between a first position (depicted by way of example in FIG. 2) and a second position (depicted by way of example in FIG. 3) towards the upper mold 1. With the lower mold 2 in the second position, both molds 1 and 2 cooperate with one another. The vacuum generation device 102 is preferably configured for generating the vacuum when the lower mold 2 is in the second position, i.e., when both molds 1 and 2 are cooperating with one another to perform packaging.

Figure 2:
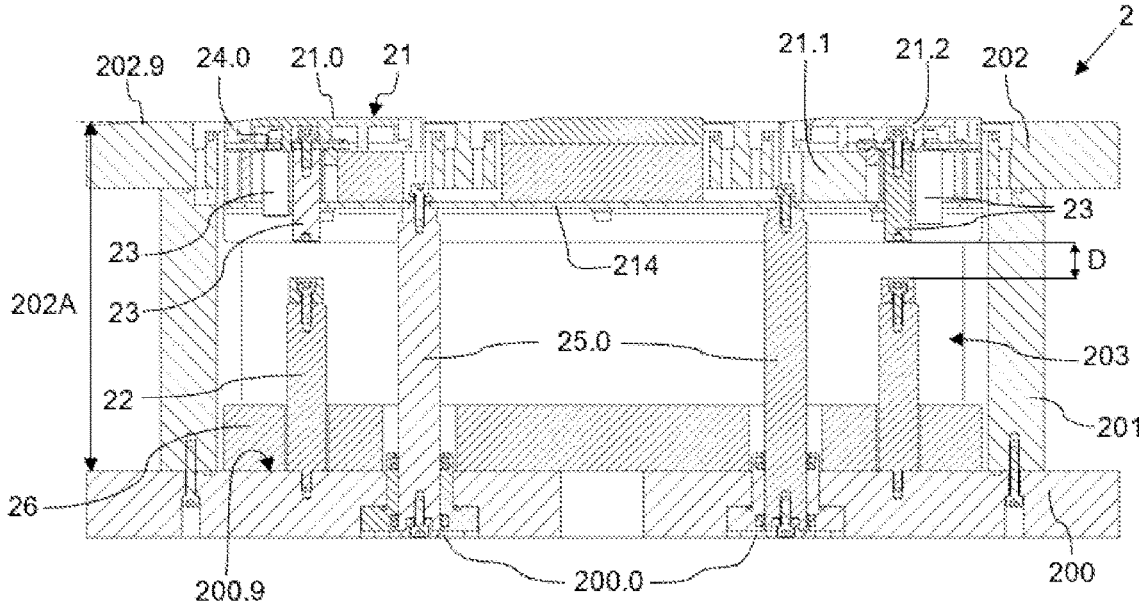
FIG. 2 shows a configuration of the lower mold of the machine of FIG. 1, in the first position and with a box frame comprising three frame cavities for three trays.
Figure 3:
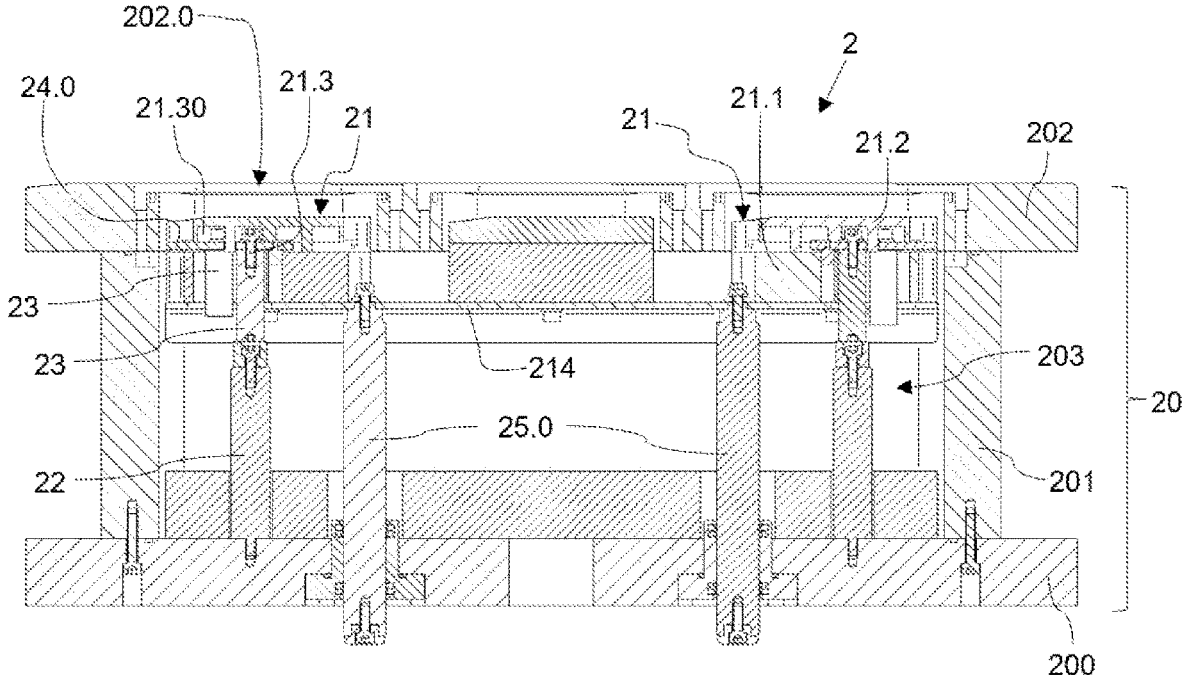
FIG. 3 shows the lower mold of FIG. 2 in the second position.

With reference to FIGS. 2 and 3, the lower mold 2 comprises a box 20 formed at least by a box base 200, a box structure 201 extending vertically upwards from the box base 200, and a box frame 202 attached to the box structure 201, such that a box cavity 203 is defined between said box frame 202, said box structure 201, and said box base 200.

The box frame 202 comprises at least one frame cavity 202.0 suitable for at least partially housing the tray, the flap of said tray being supported on an upper surface 202.9 of said box frame 202 when said tray is housed in that manner. If the molds 1 and 2 are suitable for packaging more than one product simultaneously, each one in one tray, respectively, the box frame 202 comprises as many frame cavities 202.0 as there are products it can package (one frame cavity 202.0 for each tray). The box frame 202 preferably comprises a plurality of frame cavities 202.0, shown in the embodiment of the figures.

The lower mold 2 further comprises a pad 21 attached to the box 20 with freedom of vertical movement and associated with the frame cavity 202.0 of the box 20 of said lower mold 2. The lower mold 2 comprises as many pads 21 as there are frame cavities 202.0 (one pad 21 for each frame cavity 202.0). The pad 21 preferably protrudes above the box frame 202 with the lower mold 2 in the first position, such that the tray is supported on it, and in the second position the pad 21 is housed in the frame cavity 202.0 or below said frame cavity 202.0 (in the box cavity 203), based on the height of the tray and on the vertical length of said frame cavity 202.0. Other combinations are also possible, provided that the main function of the pad 21 with the lower mold 2 in the second position, which is to prevent deformation of the tray in a possible vacuum generation as has been described in detail, is assured.

To vacuum package a product, the tray is arranged with the product to be packaged on the pad 21 with the lower mold 2 in the first position, a cover sheet 300 is arranged on the tray, covering the product, and the lower mold 2 is moved vertically towards the upper mold 1 until finishing its path of travel (until reaching the second position), such that the flap of said tray is supported on the upper surface 202.9 of the box frame 202 surrounding the frame cavity 202.0. Next, if required, the vacuum is generated at least between said cover sheet and the tray by means of the vacuum generation device 102 and with the lower mold 2 in said second position, and the cover sheet 300 is finally sealed to the tray.

The machine 100 comprises a lower stop 22 which is associated with the lower mold 2 such that it moves integrally with said lower mold 2 during the movement of said lower mold 2 from the first position to the second position, and at least one upper stop 23 which is configured for moving between an inoperative position and an operative position and which is associated with the pad 21 such that said pad 21 and said upper stop 23 move vertically in an integral manner, but the upper stop 23 moves with respect to said pad 21 when changing from the operative position to the inoperative position and vice versa.

In the operative position, the upper stop 23 is configured for being arranged in the path of travel of the lower stop 22 during the movement of said lower stop 22 integral with the lower mold 2. Therefore, during its movement the lower stop 22 will contact the upper stop 23 at some time, and after that the lower stop 22 causes the upper stop 23 to move integrally with said lower stop 22 until the lower mold 2 reaches the second position. In the inoperative position, the upper stop 23 is arranged outside of said path of travel, such that the lower stop 22 does not contact said upper stop 23 during the path of travel of said lower stop 22 integral with the lower mold 2 and does not cause the movement of said upper stop 23.

Preferably, when the lower mold 2 is in the first position, while in the operative position the upper stop 23 is configured for being vertically distanced from the lower stop 22 by a given vertical distance D, with said given vertical distance D being less than the given length of the vertical path of travel of the lower mold 2 for transitioning from the first position to the second position. Contact between the lower stop 22 and the upper stop 23 before the lower mold 2 reaches said second position is thereby ensured, vertical movement of the pad 21 being ensured.

In some embodiments, the given vertical distance D is equal to zero. In these embodiments, the lower stop 22 and the corresponding upper stop 23 are configured for being in contact even when the lower mold 2 is in the first position (at all times). Therefore, the pad 21 moves next to the lower mold 2 at all times during the path of travel of said lower mold 2 towards the second position. The lower stop 22 can protrude vertically upwards from the box base 200, it can be the actual box base 200, it can be a groove or protrusion made in the box structure 201 cooperating with the upper stop 23, or it can correspond with at least one shim 26 arranged in the box cavity 203 supported on an upper surface 200.9 of the box base 200, for example.

In other embodiments, the given vertical distance D is different from zero, so the lower stop 22 and the corresponding upper stop 23 are configured for contacting once the lower mold 2 has travelled a distance equal to said given vertical distance D from the first position towards the second position. Like before, the lower stop 22 can protrude vertically upwards from the box base 200, it can be the actual box base 200, it can be a groove or protrusion made in the box structure 201 cooperating with the upper stop 23, or it can correspond with at least one shim 26 arranged in the box cavity 203 supported on an upper surface 200.9 of the box base 200, for example.

In a preferred embodiment, the lower mold 2 comprises a plurality of upper stops 23 associated with one and the same pad 21 and a positioning mechanism configured for causing the movement of the upper stops 23 when it is actuated and, therefore, the change in position of said upper stops 23 (one of them will transition from its operative position to its inoperative position and the other one from its inoperative position to its operative position, as a result of said actuation). Each upper stop 23 is configured for being arranged at a given point along the path of travel of the lower stop 2 when it is in the operative position, with said given point being different from the given point of the path of travel in which the rest of the upper stops 23 are arranged when they are in the operative position, respectively. That is, each upper stop 23 is configured for being at a given vertical distance D with respect to the lower stop 22 when the lower mold 2 is in the first position, when it is in the operative position, with all the given vertical distances D being different from one another. In some embodiments, one of the given points of one of the upper stops 23 can be equal to the position of the lower stop 22 with the lower mold 2 in the first position, in which case the given vertical distance D associated with said corresponding upper stop 23 is equal to zero.

Figure 4:
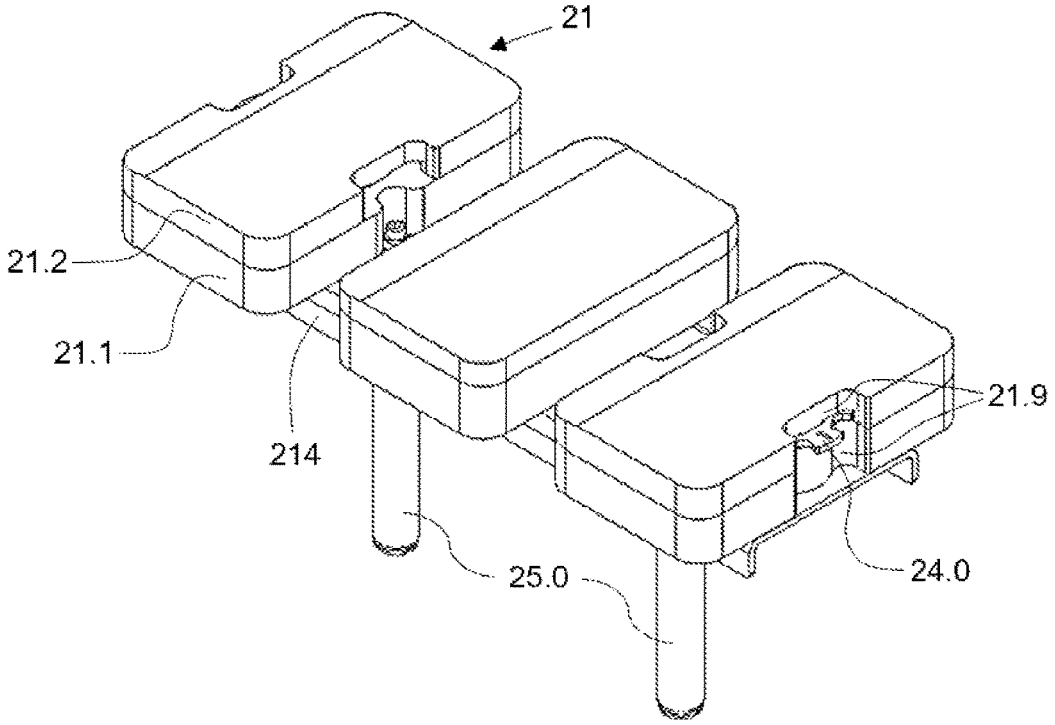
FIG. 4 shows an embodiment of the three pads of the lower mold of the machine of FIG. 1, with a support plate.
Figure 5:
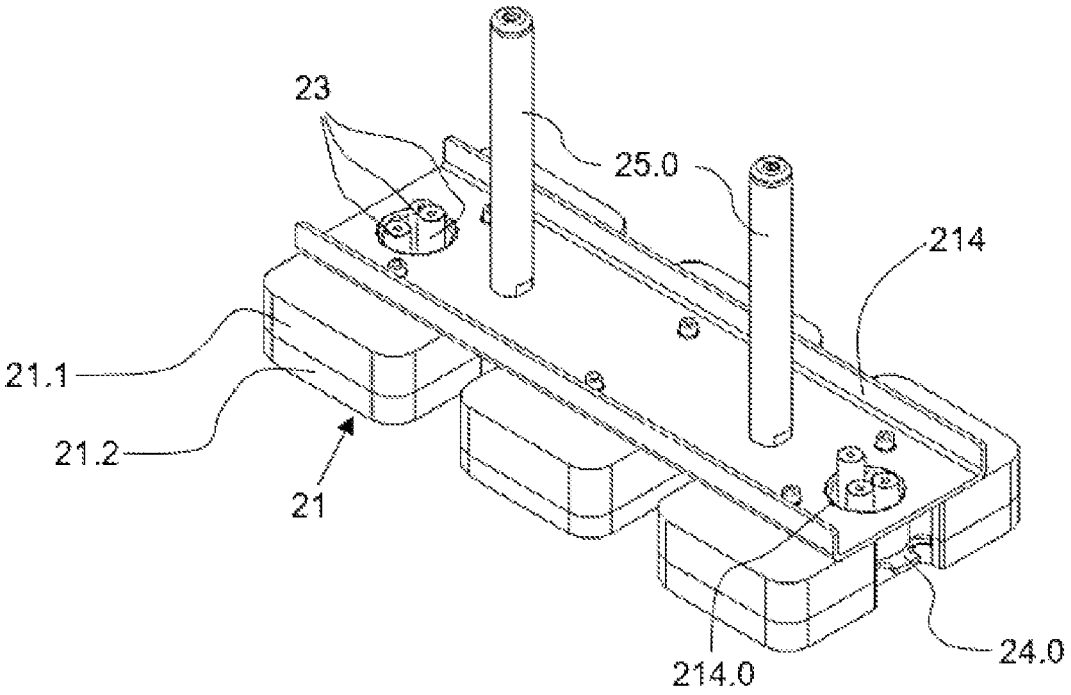
FIG. 5 shows a lower image of the pads of FIG. 4.
Figure 6:
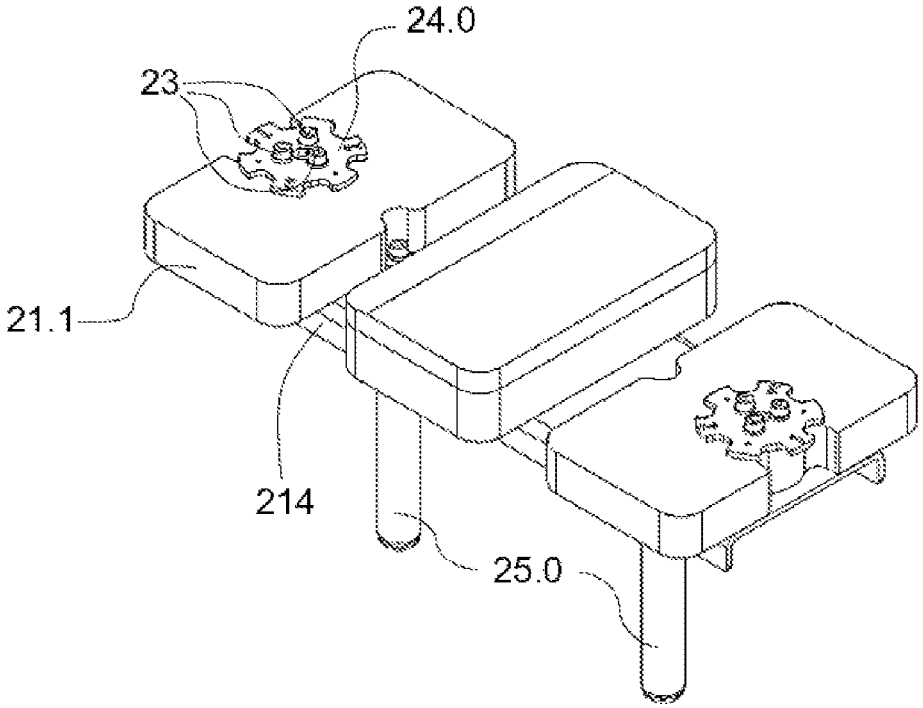
FIG. 6 shows the pads of FIG. 4, with two of them lacking a second part.

The positioning mechanism comprises a support 24.0 depicted in FIGS. 4 to 6 to which the upper stops 23 of one and the same pad 21 are attached, such that said upper stops 23 move simultaneously when the support 24.0 moves. Said support 24.0 is configured for being arranged in at least as many positions as there are upper stops 23 comprised in the lower mold 2. Therefore, in each of said positions an upper stop 23 is arranged in the path of travel of the lower stop 22 in the operative position, respectively (at a given vertical distance D from the lower stop 22), such that when the lower mold 2 moves from the first position to the second position, the lower stop 22 contacts the upper stop 23 which is in the operative position after travelling the given vertical distance D separating both stops 22 and 23, said contact occurring sooner or later based on how much said given vertical distance D is when the lower mold 2 is in the first position. The positioning mechanism can thus be acted on for arranging the required upper stop 23 in the path of travel of the lower stop 22 based on when said contact is to be produced, and therefore based on the height of the tray in which the products are to be packaged, where the machine 100 can be readily adjusted to be able to package trays of different heights. Each upper stop 23 of one and the same pad 21 is configured that way so that products can be packaged in trays of a given height (and different from one another) with said lower mold 2.

In the preferred embodiment, the upper stops 23 of one and the same pad 21 (or the only upper stop 23 of a pad 21) are facing the box base 200 of the box 20 of the lower mold 2 and comprise a given vertical length towards said base of the box 200 such that each of the upper stops 23 has a given associated vertical distance D with respect to the lower stop 22 different from the given associated vertical distance D the rest of the upper stops 23 have. Each given vertical distance D therefore depends on the length of the corresponding upper stop 23. Therefore, the upper stops 23 of one and the same pad 21 have different lengths. In other embodiments, the upper stops 23 (or at least some of them) may have one and the same length, the pad 21 or the surface to which they are attached therefore comprising an irregular shape so that different given vertical distances D can be obtained.

In the preferred embodiment, the support 24.0 of the positioning mechanism is attached to the pad 21 with rotational freedom, with said support 24.0 being configured, with its movement, for rotating with respect to said pad 21 to modify the position of the upper stops 23 associated with said pad 21. The upper stops 23 are thereby associated with the pad 21 through said support 24.0. The pad 21 preferably comprises a first part 21.1 and a second part 21.2, with the second part 21.2 being what is facing the tray and with the support 24.0 being partially arranged between the first part 21.1 and the second part 21.2 of said pad 21. The first part 21.1 and the second part 21.2 are attached to one another, and at least one of said first part 21.1 and second part 21.2 comprises a recess where the support 24.0 of the rotation mechanism is housed, such that said recess in turn guides the rotation of the support 24.0. The first part 21.1 additionally comprises a through hole configured for the upper stops 23 and/or the upper stops 22 to go through same. Preferably, the second part 21.2 comprises the recess where the support 24.0 is housed, and the first part 21.1 comprises a through hole configured for the upper stops 23 to go through same, such that said through hole makes it possible to arrange upper stops 23 as long as required without said length affecting the movement thereof between the operative position and the inoperative position. In some embodiments, the upper stops 23 are fixed to the support 24.0 preferably by means of screws 21.3 or similar elements, and the second part 21.2 of the pad 21 comprises a groove 21.30 for housing and allowing the movement of the heads of said screws 21.3.

The movement of the support 24.0 may be caused by means of an actuator such as a cylinder or a motor, for example, or it may be caused manually. To do so manually, the support 24.0 is accessible so that it can be moved manually from outside the lower mold 2, at least with the lower mold 2 in the first position. In the embodiments in which the support 24.0 is arranged at least partially between the two parts 21.1 and 21.2 of the pad 21, said two parts 21.1 and 21.2 preferably comprise a recess 21.9 respectively so that the support 24.0 protrudes at least partially from said pad 21 and can thus be accessed from outside of the lower mold 2.

The lower mold 2 preferably comprises a guiding device attached to the pad 21 for guiding the movement of the pad 21 and preventing it from being loosened with respect to the corresponding frame cavity 202.0 during movement. The guiding device comprises at least one vertical guiding rod 25.0, and the box base 200 of the lower mold 2 comprises at least one through hole 200.0 where the guiding rod 25.0 is partially housed. The guiding rod 25.0 is attached to the pad 21, said guiding rod 25.0 moving integrally with said pad 21, and as a result of the through hole 200.0 of the box base 200, which serves as a guide in said movement, the pad 21 is kept in the transverse position with respect to the corresponding frame cavity 202.0.

The machine 100 comprises a frame not depicted in the figures, said frame comprising a frame base 103 below the lower mold 2. When the lower mold 2 is in the first position, the guiding rod 25.0 is supported on said frame base 103 (going through the through hole 200.0 of the box base 200). This allows being able to arrange the pad 21 where required with respect to the box frame 202 with the lower mold 2 in the first position, based on the length of the guiding rod 25.0. Said guiding rod 25.0 preferably comprises a length which allows an upper surface 21.0 of the pad 21 to be arranged at a height equal to or greater than the height 202A at which the upper surface 202.9 of said box frame 202 is located with respect to the box base 200, when the lower mold 2 is in the first position, which facilitates arranging and extracting the trays in/from the lower mold 2.

When the lower mold 2 moves towards the second position, the guiding rod 25.0 continues to be supported in the frame base 103 (it preferably protrudes below the box base 200 of the lower mold 2 as the lower mold 2 moves forward) until the lower stop 22 contacts the upper stop 23 which is in the operative position. After that, and until the lower mold 2 reaches the second position, the guiding rod 25.0 it moves integrally with said lower mold 2 and with the pad 21, no longer being supported in the frame base 103. That is, when the lower mold 2 is arranged at a height with respect to the base of the frame 103 that is greater than the corresponding given vertical distance D, the guiding rod 25.0 stops being supported on the base of the frame 103.

The lower mold 2 preferably comprises a plurality of pads 21, a box frame 202 with one frame cavity 202.0 for each pad 21, and a support plate 214 attached to said plurality of pads 21 and facing the box base 200 of the box 20 of said lower mold 2, with the guiding rod 25.0 being attached to said support plate 214 (preferably an end of said guiding rod 25.0 is attached to said support plate 214). Said guiding rod 25.0 is thereby attached to the plurality of pads 21 through said support plate 214. Having a support plate 214 allows being able to use a smaller number of guide rods 25.0 than the number of pads 21 when the lower mold 2 comprises a plurality of pads 21, which simplifies the machine 100 and reduces its cost. Likewise, the presence of the support plate 214 allows being able to use a smaller number of upper stops 22 than the number of pads 21, and a smaller number of upper stops 23, when the lower mold 2 comprises a plurality of pads 21, which results in the simplification of the machine 100 and in the reduction of its cost. In this case, the lower mold 2 preferably comprises a lower stop 22 associated with each of the pads 21 arranged at the ends, comprising no lower stop for the pads 21 arranged between said two end pads 21. The machine 100 comprises at least one upper stop 23 associated with each of the stops 22, not all the pads 21 having an associated upper stop 23. This allows easy accessibility to these elements as they are at the ends, in addition to helping with the homogeneous pushing on the support plate 214 and, therefore, on all the pads 21 during the movement of the lower mold 2 towards the second position once the upper stops 22 contact the corresponding upper stops 23 arranged in the operative position. The support plate 214 comprises a hole 214.0 that the upper stop 23 (or upper stops 23) of each pad 21 goes through, comprising at least one upper stop 23, and/or which the lower stop 22 goes through, respectively. When the lower mold 2 comprises a plurality of upper stops 22 and a plurality of upper stops 23 (at least one upper stop 23 for each lower stop 22), the positioning mechanism is preferably configured for arranging the associated upper stops 23 with the different pads 21, such that when a plurality of upper stops 23 are arranged in the operative position, respectively (preferably one upper stop 23 per pad 21 having associated upper stops 23), the given vertical distance D of all the upper stops 23 which are in the operative position is the same.

These and other embodiments are disclosed in the clauses that follow.

Clause 1. A thermosealing machine for packaging products, comprising a lower mold (2) configured for moving along a vertical path of travel of a given length between a first position and a second position, the lower mold (2) comprising a box (20) formed at least by a box base (200), a box structure (201) extending vertically upwards from the box base (200), and a box frame (202) comprising at least one frame cavity (202.0) and attached to the box structure (201) such that a box cavity (203) is defined between said box frame (202), said box structure (201), and said box base (200); and at least one pad (21) attached to the box (20) with freedom of vertical movement and associated with the frame cavity (202) of said box (20), characterized in that the machine (100) comprises a lower stop (22) which is associated with the lower mold (2) such that it moves integrally with said lower mold (2) during the movement of said lower mold (2) from the first position to the second position, and at least one upper stop (23) which is associated with the pad (21) such that said pad (21) and said upper stop (23) move vertically in an integral manner, said upper stop (23) being configured so that moving between an operative position, in which said upper stop (23) is arranged in the path of travel of the lower stop (22) during the movement of said lower stop (22) integral with the lower mold (2), such that said upper stop (23) moves integrally with said lower stop (22) from the time said lower stop (22) contacts said upper stop (23) until the lower mold (2) reaches the second position, and an inoperative position in which said upper stop (23) is arranged outside of said path of travel of the lower stop (22).

Clause 2. The thermosealing machine according to clause 1, wherein when the lower mold (2) is in the first position, the upper stop (23) is configured for being vertically distanced from the lower stop (22) by a given vertical distance (D) while in the operative position, with said given vertical distance (D) being less than the given length of the vertical path of travel of the lower mold (2) for transitioning from the first position to the second position.

Clause 3. The thermosealing machine according to clause 2, wherein the lower mold (2) comprises a plurality of upper stops (23) associated with one and the same pad (21) and a positioning mechanism configured for causing the movement of the upper stops (23) when it is actuated, the positioning mechanism comprising a support (24.0) to which all the upper stops (23) are attached and with said support (24.0) being configured so that being arranged in at least as many positions as there are upper stops (23) comprised in the lower mold (2), such that, in each of said positions, an upper stop (23) is in the respective operative position facing the lower stop (22) of said lower mold (2), said upper stops (23) being configured so that, while being in the respective operative positions, the given vertical distance (D) of an upper stop (23) with respect to the lower stop (22) is different from the corresponding given vertical distance (D) of the rest of the upper stops (23) with respect to said lower stop (22).

Clause 4. The thermosealing machine according to clause 3, wherein the upper stops (23) are facing the box base (200) and comprise a given vertical length towards said base of the box (200), all the upper stops (23) comprising different lengths, and with the given vertical distance (D) of an upper stop (23) with respect to the lower stop (22) depending on said length of said upper stop (23).

Clause 5. The thermosealing machine according to clause 4, wherein the support (24.0) of the positioning mechanism is attached to the pad (21) with rotational freedom, with said support (24.0) being configured for rotating, with its movement, with respect to said pad (21) to modify the position of the upper stops (23) associated with said pad (21).

Clause 6. The thermosealing machine according to clause 5, wherein the support (24.0) attached to a pad (21) is configured for rotating with respect to a point of rotation, with the upper stops (23) being associated with said pad (21) distributed along a circumference which is described around said point of rotation, with a center at said point of rotation.

Clause 7. The thermosealing machine according to clause 5 or 6, comprising an actuator for causing the rotation of the support (24.0) of the positioning mechanism, and/or wherein the support (24.0) is accessible so that it can be moved manually from outside the lower mold (2).

Clause 8. The thermosealing machine according to any of the clauses 1 to 7, wherein the lower mold (2) comprises a guiding device attached to the pad (21), the guiding device comprising at least one vertical guiding rod (25.0) attached to the pad (21) and integrally movable with said pad (21), and the box base (200) of the lower mold (2) comprising at least one through hole (200.0) which said guiding rod (25.0) goes through.

Clause 9. A thermosealing machine according to clause 8, comprising a frame with a frame base (103) arranged below the lower mold (2), with the guiding rod (25.0) being configured for being supported on said frame base (103) when the lower mold (2) is between the first position and the position in which the lower stop (22) contacts the upper stop (23) arranged in the operative position.

Clause 10. The thermosealing machine according to clause 8 or 9, wherein the lower mold (2) comprises a plurality of pads (21), a box frame (202) with one frame cavity (202.0) for each pad (21), and a support plate (214) attached to said plurality of pads (21), with the guiding rod (25.0) being attached to said support plate (214) such that said guiding rod (25.0) is attached to the plurality of pads (21) through said support plate (214).

Clause 11. The thermosealing machine according to clause 10, wherein the lower mold (2) comprises a lower stop (22) associated with at least two pads (21).

Clause 12. The thermosealing machine according to clause 11, wherein the support plate (214) comprises a hole (214.0) for each pad (21) having an associated lower stop (22), with the upper stop (23), or the upper stops (23), and/or the lower stop (22) associated with the corresponding pad (21) going through each hole (214.0).

Clause 13. The thermosealing machine according to any of clauses 8 to 12, wherein the guiding rod (25.0) comprises a length which allows an upper surface (21.0) of the pad (21) to be arranged at a height equal to or greater than the height (202A) at which an upper surface (202.9) of the box frame (202) with respect to the box base (200) is located when the lower mold (2) is in the first position.

Clause 14. The thermosealing machine according to any of clauses 1 to 12, wherein the lower mold (2) is configured so that, while in the first position, an upper surface (21.0) of the pad (21) is at a height equal to or greater than the height (202A) at which an upper surface (202.9) of the box frame (202) with respect to the box base (200) is located.

Clause 15. The thermosealing machine according to any of clauses 1 to 14, comprising a vacuum generation device (102) configured for generating a vacuum between the lower mold (2) and the upper mold (1) when the lower mold (2) is in the second position.

What is claimed is:

1. A thermosealing machine for packaging products, comprising:

a lower mold configured to move along a vertical path of travel of a given length between a first position and a second position, the lower mold including a box, a frame cavity located in an upper portion of the box, and a pad coupled to the box with freedom of vertical movement and at least partially located inside the frame cavity of the box;

a lower stop associated with the lower mold such that the lower stop moves with the lower mold during movement of the lower mold from the first position to the second position;

an upper stop operatively coupled with the pad such that the pad and the upper stop move vertically in unison with one another, the upper stop being configured to assume an operative position and an inoperative position, wherein when in the operative position the upper stop is arranged in a path of travel of the lower stop and configured to move in unison with the lower stop from the time the lower stop contacts the upper stop until the lower mold reaches the second position, wherein when in the inoperative position the upper stop is arranged outside of the path of travel of the lower stop, and wherein when the lower mold is in the first position, the upper stop is vertically distanced from the lower stop by a given vertical distance while the upper stop is in the operative position, the given vertical distance being less than the given length of the vertical path of travel of the lower mold for transitioning from the first position to the second position.

2. The thermosealing machine according to claim 1, wherein the box is formed at least by a box base, a box structure extending vertically upwards from the box base, and a box frame that includes the frame cavity and is attached to the box structure such that a box cavity is defined between the box frame, the box structure, and the box base.

3. The thermosealing machine according to claim 1, wherein the lower mold comprises a plurality of upper stops operatively coupled with the pad, and a positioning mechanism configured to cause a movement of the plurality of upper stops when the positioning mechanism is actuated, the positioning mechanism including a support to which all the plurality of upper stops are coupled, the support being configured to assume a number of different positions, the number of different positions being the same as the number of upper stops, such that in each of the number of different positions one of the plurality of upper stops is in a respective operative position facing the lower stop of the lower mold, each of the plurality of upper stops being configured so that, while being in the respective operative position, a given vertical distance of one of the plurality of upper stops from the lower stop is different from a corresponding given vertical distance of each of the other upper stops from the lower stop.

4. The thermosealing machine according to claim 3, wherein the box is formed at least by a box base, a box structure extending vertically upwards from the box base, and a box frame that includes the frame cavity and is attached to the box structure such that a box cavity is defined between the box frame, said box structure, and the box base.

5. The thermosealing machine according to claim 4, wherein the plurality of upper stops face the box base and comprise a given vertical length towards the box base, each of the plurality of upper stops having a different length than the other upper stops, a given vertical distance of each of the plurality of upper stops from the lower stop depending on the given vertical length of each of the plurality of upper stops.

6. The thermosealing machine according to claim 3, wherein the support of the positioning mechanism is coupled to the pad with rotational freedom of movement, the support being configured to rotate with respect to the pad to modify a position of the plurality of upper stops associated with the pad.

7. The thermosealing machine according to claim 4, wherein the support is configured to rotate about an axis of rotation, with the plurality of upper stops distributed around the axis of rotation.

8. The thermosealing machine according to claim 4, further comprising an actuator operatively coupled to the support to cause the support to rotate.

9. The thermosealing machine according to claim 4, wherein the support is accessible from an outside of the lower mold so that the support can be moved manually from outside the lower mold.

10. The thermosealing machine according to claim 2, wherein the lower mold comprises a guiding device attached to the pad, the guiding device comprising at least one vertical guiding rod attached to the pad and integrally movable with the pad, the box base including a through hole through which the at least one vertical guiding rod passes.

11. The thermosealing machine according to claim 10, comprising a frame with a frame base arranged below the lower mold, the at least one vertical guiding rod being configured to be supported on the frame base when the lower mold is between the first position and a position in which the lower stop contacts the upper stop.

12. The thermosealing machine according to claim 10, wherein the lower mold comprises a plurality of pads, a plurality of box frames each having a frame cavity for each of the plurality of pads, and a support plate attached to the plurality of pads, with the at least one vertical guiding rod being attached to the support plate such that the at least one vertical guiding rod is coupled to the plurality of pads through the support plate.

13. The thermosealing machine according to claim 12, wherein the lower stop of the lower mold can be operatively connected with at least two of the plurality of pads.

14. The thermosealing machine according to claim 12, wherein the support plate comprises a hole through which one or both of the lower and upper stops pass to enable the lower and upper stops to cooperate with one another when the upper stop is in the operative position.

15. The thermosealing machine according to claim 10, wherein the at least one vertical guiding rod has a length that allows an upper surface of the pad to be arranged at a height equal to or greater than a height of an upper surface of the box frame when the lower mold is in the first position.

16. The thermosealing machine according to claim 2, wherein the lower mold is configured so that, while in the first position, an upper surface of the pad is at a height equal to or greater than a height of an upper surface of the box frame.

17. The thermosealing machine according to claim 1, comprising an upper mold and a vacuum generation device configured to generate a vacuum between the lower mold and the upper mold when the lower mold is in the second position.

18. A thermosealing machine for packaging products, comprising:

a lower mold configured to move along a vertical path of travel of a given length between a first position and a second position, the lower mold including a box, a frame cavity located in an upper portion of the box, and a pad coupled to the box with freedom of vertical movement and at least partially located inside the frame cavity of the box;

a lower stop associated with the lower mold such that the lower stop moves with the lower mold during movement of the lower mold from the first position to the second position;

an upper stop operatively coupled with the pad such that the pad and the upper stop move vertically in unison with one another, the upper stop being configured to assume an operative position and an inoperative position, wherein when in the operative position the upper stop is arranged in a path of travel of the lower stop and configured to move in unison with the lower stop from the time the lower stop contacts the upper stop until the lower mold reaches the second position, and wherein when in the inoperative position the upper stop is arranged outside of the path of travel of the lower stop;

an upper mold; and a vacuum generation device configured to generate a vacuum between the lower mold and the upper mold when the lower mold is in the second position.

19. A thermosealing machine for packaging products, comprising:

a lower mold configured to move along a vertical path of travel of a given length between a first position and a second position, the lower mold including a box, a frame cavity located in an upper portion of the box, and a pad coupled to the box with freedom of vertical movement and at least partially located inside the frame cavity of the box;

a lower stop associated with the lower mold such that the lower stop moves with the lower mold during movement of the lower mold from the first position to the second position;

an upper stop operatively coupled with the pad such that the pad and the upper stop move vertically in unison with one another, the upper stop being configured to assume an operative position and an inoperative position, wherein when in the operative position the upper stop is arranged in a path of travel of the lower stop and configured to move in unison with the lower stop from the time the lower stop contacts the upper stop until the lower mold reaches the second position, wherein when in the inoperative position the upper stop is arranged outside of the path of travel of the lower stop, wherein the box is formed at least by a box base, a box structure extending vertically upwards from the box base, and a box frame that includes the frame cavity and is attached to the box structure such that a box cavity is defined between the box frame, the box structure, and the box base, wherein the lower mold comprises a guiding device attached to the pad, the guiding device comprising at least one vertical guiding rod attached to the pad and integrally movable with the pad, the box base including a through hole through which the at least one vertical guiding rod passes, wherein the lower mold comprises a plurality of pads, a plurality of box frames each having a frame cavity for each of the plurality of pads, and a support plate attached to the plurality of pads, with the at least one vertical guiding rod being attached to the support plate such that the at least one vertical guiding rod is coupled to the plurality of pads through the support plate.

* * * * *